US010013904B2

(12) United States Patent
Park

(10) Patent No.: US 10,013,904 B2
(45) Date of Patent: Jul. 3, 2018

(54) IMAGE PROCESSING METHOD, IMAGE PROCESSING CIRCUIT AND DISPLAY DEVICE USING THE SAME TO IMPROVE IMAGE QUALITY OF A HIGH DYNAMIC RANGE IMAGE FOR DISPLAY IN A STANDARD DYNAMIC RANGE DISPLAY DEVICE

(71) Applicant: LG Display Co., Ltd., Seoul (KR)

(72) Inventor: Yong-Min Park, Goyang-si (KR)

(73) Assignee: LG Display Co., Ltd., Seoul (KR)

( * ) Notice: Subject to any disclaimer, the term of this patent is extended or adjusted under 35 U.S.C. 154(b) by 233 days.

(21) Appl. No.: 15/091,409

(22) Filed: Apr. 5, 2016

(65) Prior Publication Data

US 2016/0322020 A1 Nov. 3, 2016

(30) Foreign Application Priority Data

Apr. 29, 2015 (KR) ..... 10-2015-0060518

(51) Int. Cl.

| | |
|---|---|
| ***G09G 3/20*** | (2006.01) |
| ***G09G 3/34*** | (2006.01) |
| ***G09G 3/36*** | (2006.01) |
| ***G09G 5/02*** | (2006.01) |

(52) U.S. Cl.

CPC ..... *G09G 3/2003* (2013.01); *G09G 3/3406* (2013.01); *G09G 3/3696* (2013.01); *G09G 5/026* (2013.01); *G09G 2320/0242* (2013.01); *G09G 2320/0673* (2013.01); *G09G 2340/06* (2013.01); *G09G 2360/16* (2013.01)

(58) Field of Classification Search

None

See application file for complete search history.

(56) References Cited

U.S. PATENT DOCUMENTS

| | | | | |
|---|---|---|---|---|
| 2009/0027558 | A1* | 1/2009 | Mantiuk | H04N 1/6027 348/673 |
| 2013/0038790 | A1* | 2/2013 | Seetzen | G09G 5/02 348/453 |
| 2013/0076974 | A1* | 3/2013 | Atkins | H04N 5/235 348/362 |
| 2015/0245044 | A1* | 8/2015 | Guo | H04N 21/42202 375/240.03 |

* cited by examiner

*Primary Examiner* — Hilina K Demeter

(74) *Attorney, Agent, or Firm* — Fenwick & West LLP

(57) ABSTRACT

An image processing method and circuit, and a display device using the same, for minimizing image quality degradation of a high dynamic range (HDR) image without gamma transformation of a data drive integrated circuit (IC) and displaying the image in a standard dynamic range (SDR) display device are disclosed. The image processing method includes selecting a gamma curve with a first image having an HDR and cumulative minimum luminance error among a plurality of gamma curves corresponding to a display device having a SDR, and converting the first image into a second image having an SDR according to the selected gamma curve.

13 Claims, 9 Drawing Sheets

| 8-bit PQ | 8-bit 400 | 8-bit 800 | 8-bit 1000 | 8-bit 1500 | 8-bit 2000 | 8-bit 4000 |
|---|---|---|---|---|---|---|
| 0 | 0 | 0 | 0 | 0 | 0 | 0 |
| 1 | 0 | 0 | 0 | 0 | 0 | 0 |
| 2 | 1 | 1 | 1 | 0 | 0 | 0 |
| 3 | 1 | 1 | 1 | 1 | 1 | 0 |
| 4 | 2 | 1 | 1 | 1 | 1 | 1 |
| 5 | 2 | 1 | 1 | 1 | 1 | 1 |
| 6 | 2 | 2 | 1 | 1 | 1 | 1 |
| 7 | 3 | 2 | 2 | 1 | 1 | 1 |
| 8 | 3 | 2 | 2 | 2 | 1 | 1 |
| 9 | 3 | 2 | 2 | 2 | 2 | 1 |
| 10 | 4 | 3 | 2 | 2 | 2 | 1 |
| 11 | 4 | 3 | 3 | 2 | 2 | 1 |
| 12 | 4 | 3 | 3 | 2 | 2 | 2 |
| 13 | 5 | 3 | 3 | 3 | 2 | 2 |
| 14 | 5 | 4 | 3 | 3 | 2 | 2 |
| 15 | 6 | 4 | 4 | 3 | 3 | 2 |
| 16 | 6 | 4 | 4 | 3 | 3 | 2 |

IMAGE PROCESSING METHOD, IMAGE PROCESSING CIRCUIT AND DISPLAY DEVICE USING THE SAME TO IMPROVE IMAGE QUALITY OF A HIGH DYNAMIC RANGE IMAGE FOR DISPLAY IN A STANDARD DYNAMIC RANGE DISPLAY DEVICE

This application claims the benefit of Republic of Korea Patent Application No. 10-2015-0060518, filed on Apr. 29, 2015, which is hereby incorporated by reference as if fully set forth herein.

BACKGROUND OF THE INVENTION

Field of the Invention

The present invention relates to a display device, and more particularly, to an image processing method and circuit, and a display device using the same, for minimizing image quality degradation of a high dynamic range (HDR) image and displaying the image in a standard dynamic range (SDR) display device.

Discussion of the Related Art

In general, a captured image is required to be digitized in order to display the image on a display device. In this case, gamma encoding and gamma decoding processes are required. The gamma encoding is used to contain a large amount of information in a given bandwidth (e.g., a 8-bit image signal has a gray scale of 256), is relatively sensitive to change in brightness in a low luminance period compared with a high luminance period according to human vision cognitive characteristics, that is, having nonlinear characteristics. In consideration of this, a nonlinear transfer function is used during gamma encoding and is defined according to Recommendation (Rec.) 709 and Rec. 1886 standard that use a reciprocal of 2.4 as an index. The display device determines a gamma reference voltage in consideration of a function having, as an index, 2.4 as a reverse function of a transfer function used in encoding in order to convert a gamma encoded image into originally intended luminance for each gray scale.

A display device that is considered according to the conventional Rec. 709 standard is a cathode-ray tube (CRT), and thus the device has a narrow dynamic range of about 0 to 100 cd/m$^2$. However, 2.4 is proper to a dynamic range of the CRT, and thus, when the dynamic range is increased, 2.4 is not appropriate to human vision cognitive characteristics. In reality, the human has a wide dynamic range of about $10^{-4}$-$10^{8}$ cd/m$^2$. Technology in consideration of this is a high dynamic range (HDR) and thus far, the HDR technology has been mostly concentrated on camera fields.

Recently, there has been movement for expanding HDR to film production, display development, etc., and Society of Motion Picture and Television Engineers (SMPTE) standard (ST.) 2084 standard, Blu-ray Disc Association (BDA) HDR standard, etc. have been representatively established and discussed. The SMPTE ST. 2084 standard refers to an electro-optical transfer function (EOTF) for encoding an HDR image for an HDR display device and is also referred to as a perceptual quantizer (PQ).

Ad described above, the gamma encoding is used to contain a large amount of information in a given bandwidth if possible and decoding is a process for converting encoded information into an original brightness expression. Accordingly, encoding and decoding have a relationship of a reverse function, and thus when encoding and decoding functions are different, image quality degradation is caused.

That is, although an HDR image needs to have higher image quality than a standard dynamic range (SDR) image, when the HDR image is displayed in a conventional SDR display device, image quality of the HDR image is degraded compared with the SDR image due to different decoding and decoding functions.

This is because most conventional SDR display devices decode an images using gamma defined according to the conventional SDR standard (Rec. 709/Rec. 1886) and thus do not decode the HDR image encoded according to the HDR standard (ST. 2084), which is not overcome even if a dynamic range of the display device is increased.

On the other hand, in the case of a display device that is conformable to the HDR standard (ST. 2084), an HDR image is accurately displayed but an SDR image is not accurately displayed.

In order to overcome these problems, a decoding function that accurately corresponds to a transfer function of encoding an image needs to be embodied in a display device. Accordingly, in order to appropriately display both an SDR image and an HDR image in terms of a display device, it is most ideal that respective decoding functions EOTF of SDR and HDR are embodied in a data drive IC, but there is a problem in terms of high cost.

SUMMARY OF THE INVENTION

Accordingly, the present invention is directed to an image processing method, an image processing circuit, and a display device using the same that substantially obviates one or more problems due to limitations and disadvantages of the related art.

An object of the present invention is to provide an image processing method and circuit, and a display device using the same, for minimizing image quality degradation of a high dynamic range (HDR) image and displaying the HDR image in a standard dynamic range (SDR) display device without gamma transformation of a data drive integrated circuit (IC).

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, an image processing method includes selecting a gamma curve with a first image having a high dynamic range (HDR) and cumulative minimum luminance error among a plurality of gamma curves corresponding to a display device having a standard dynamic range (SDR), and converting the first image into a second image having an SDR according to the selected gamma curve.

The selecting of the gamma curve may include mapping the first image to each of the gamma curves with different maximum luminance to calculate luminance error for each frame, accumulating the calculated luminance error, and detecting cumulative luminance error for each of the gamma curves, selecting the gamma curve with the cumulative minimum error among the cumulative luminance error of each of the gamma curves, and determining and outputting maximum luminance of the selected gamma curve.

The converting of the first image into the second image may include selecting a look-up table (LUT) corresponding to the determined maximum luminance among preset HDR-to-SDR, converting LUTs corresponding to the respective gamma curves, and mapping the first image to the second image using the selected LUT.

The image processing method may further include, prior to selection of any one of the gamma curves, determining a roll-off inflection point according to image characteristics based on a result obtained via analysis of the first image, and roll-off processing a high gray scale equal to or more than the determined roll-off inflection point in the first image.

The determining of the roll-off inflection point may include analyzing a histogram of the first image to calculate a high gray frequency of high n % (n is a natural number less than 100) or more and adaptively determining the roll-off inflection point according to the calculated high gray frequency.

The image processing method may further include, prior to the analyzing of the first image, determining whether an input image is an HDR image or an SDR image according to an option image, and bypassing the input image when the input image is the SDR image and supplying the input image as the first image when the input image is the HDR image.

In another aspect of the present invention, an image processing circuit includes a roll-off processor for determining a roll-off inflection point according to image characteristics based on a result obtained via analysis of a first image having a high dynamic range (HDR) and roll-off processing a high gray scale equal to or more than the determined roll-off inflection point in the first image in order to display the first image having a HDR in a display device having a standard dynamic range (SDR), and an image mapper for selecting a gamma curve with the first image and cumulative minimum luminance error among a plurality of gamma curves corresponding to the display device, and converting the first image into a second image with the SDR according to the selected gamma curve.

The roll-off processor may include a histogram analyzer for analyzing a histogram of the first image to calculate and output a high gray frequency of high n % (n is a natural number less than 100) or more, and a roll-off inflection point determiner for adaptively determining the roll-off inflection point according to the calculated high gray frequency.

The image mapper may include a cumulative luminance error detector for mapping the first image to each of the gamma curves with different maximum luminance to calculate luminance error for each frame, accumulating the calculated luminance error, and detecting cumulative luminance error for each of the gamma curves, a maximum luminance determiner for selecting the gamma curve with the cumulative minimum error among the cumulative luminance error of each of the gamma curves and determining and outputting maximum luminance of the selected gamma curve, and an HDR-to-SDR converter for selecting a look-up table (LUT) corresponding to the determined maximum luminance among preset HDR-to-SDR converting LUTs corresponding to the respective gamma curves and mapping the first image to the second image using the selected LUT.

The image processing circuit may further include a content selector positioned in front of the roll-off processor, for determining whether an input image is an HDR image or an SDR image according to an option image, bypassing the input image when the input image is the SDR image, and supplying the input image as the first image to the roll-off processor when the input image is the HDR image.

In another aspect of the present invention, a display device includes a display panel, the image processing circuit, a panel driver for displaying an image supplied from the image processing circuit in the display panel, and a timing controller for controlling driving timing of the panel driver, wherein the image processing circuit is installed in the timing controller, positioned between the timing controller and the panel driver, or positioned at a front end of the timing controller.

The display device may further include a backlight unit for irradiating light to the display panel, and a backlight driver for adjusting luminance of the backlight unit in response to a dimming value output from the timing controller using the maximum luminance determined by the image processing circuit.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Figure 1:
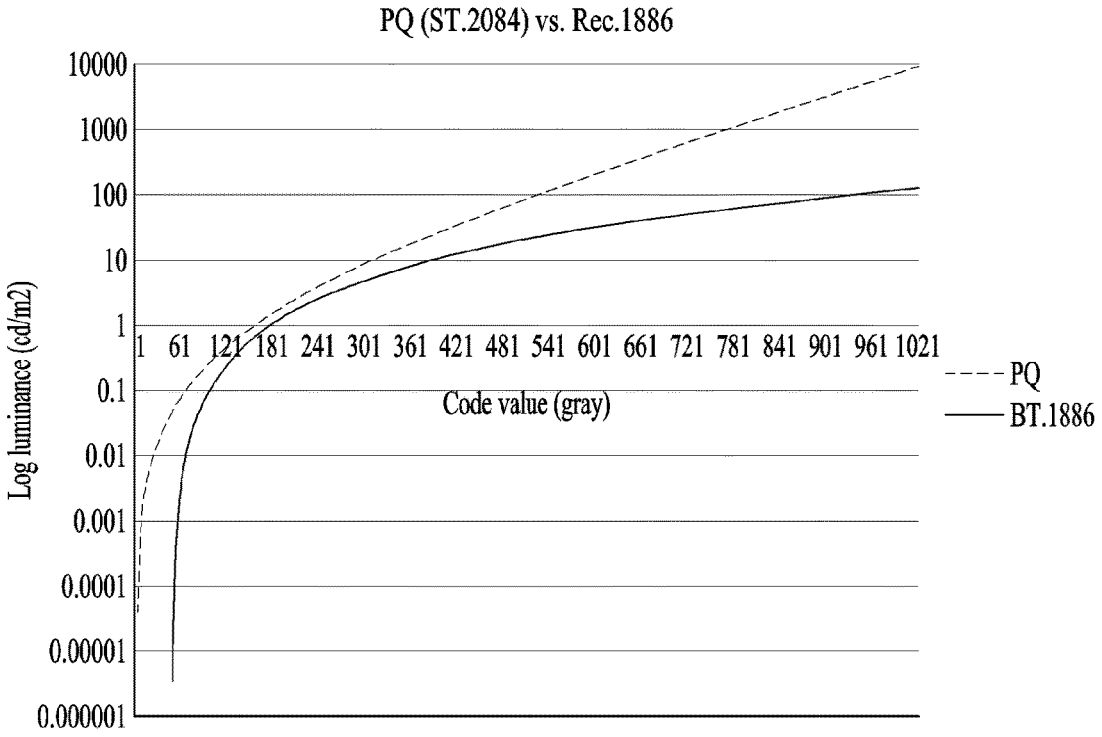
FIG. 1 is a graph showing comparison between a PQ encoding curve according to a HDR transfer function (ST. 2084) and a gamma encoding curve according to a standard dynamic range (SDR) transfer function (Rec. 1886) for understanding of the present invention.

FIG. 1 is a graph showing comparison between a PQ encoding curve according to a HDR transfer function (ST.

2084) and a gamma encoding curve according to a standard dynamic range (SDR) transfer function (Rec. 1886) for understanding of the present invention.

SMPTE ST. 2084 that considers an HDR display device may have a dynamic range of 0 to 10,000 cd/m$^2$, which is determined in consideration of a much wider dynamic range than 0 to 100 cd/m$^2$ of a conventional SDR display device. Accordingly, a ST. 2084 transfer function of encoding an HDR image and a BT. 1886 transfer function of encoding an SDR image may have a large difference.

As seen from FIG. 1, a PQ encoding curve (dashed line) showing a plot of a gray scale versus luminance according to an ST. 2084 transfer function as the HDR standard and a gamma encoding curve (solid line) showing a gray scale versus luminance according to a BT. 1886 transfer function as the SDR standard have a large difference.

The present invention proposes a method for realizing an SDR image and an HDR image with minimum degradation of image quality without gamma transformation of a drive integrated circuit (IC) in an SDR display device that is conformable to the SDR transfer function (Rec. 709/Rec. 1886).

To this end, the basic concept of the present invention may be interpreted as data conversion of an image encoded according to the HDR transfer function (ST. 2084), that is, PQ into an image encoding according to the SDR transfer function (Rec. 709/Rec. 1886).

Figure 2:
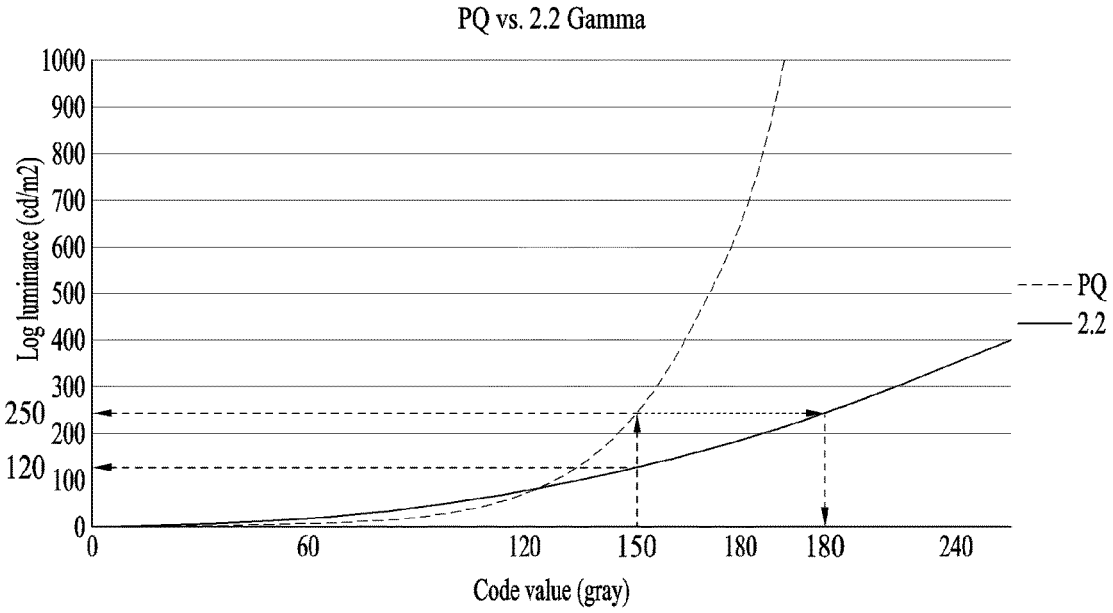
FIG. 2 is a graph showing comparison between a PQ decoding curve according to a HDR transfer function ST. 2084 and a gamma decoding curve according to a SDR transfer function (Rec. 1886) for understanding of the present invention.

FIG. 2 is a graph showing comparison between a PQ curve at a decoding time point according to the HDR transfer function ST. 2084 (PQ) and a 2.2 gamma curve at a decoding time point according to the SDR transfer function for understanding of the basic concept of the present invention.

Referring to FIG. 2, a gray scale of 150 of the image encoded according to PQ should be displayed as about 250 nits in a display device but is displayed as 120 nits in a SDR display device of a maximum of 400 nits, which is conformable to gamma 2.2. Accordingly, as described in the discussion of the related art, an HDR image is displayed as dark by the SDR display device.

On the other hand, referring to FIG. 2, when the SDR display device changes (maps) a gray scale of 150 of an HDR image to a gray scale of 180, the gray scale of 150 may be displayed as the same value as in the case of encoding, that is, 250 nits However, such a simple data mapping method may cause several problems. First, 1:1 matching is not possible in the same bandwidth (e.g., assuming that both PQ and 2.2 gamma have 8 bits), and thus gray loss is caused. Second, a dynamic range of PQ is generally wider than a dynamic range of the display device. Accordingly, in FIG. 2, a gray scale of 200 of an image encoded according to PQ exceeds about 1,000 nits but cannot be displayed in the SDR display device of a maximum of 400 nits, and thus high scale luminance is saturated to cause gray agglomeration in a high gray scale.

Figure 3:
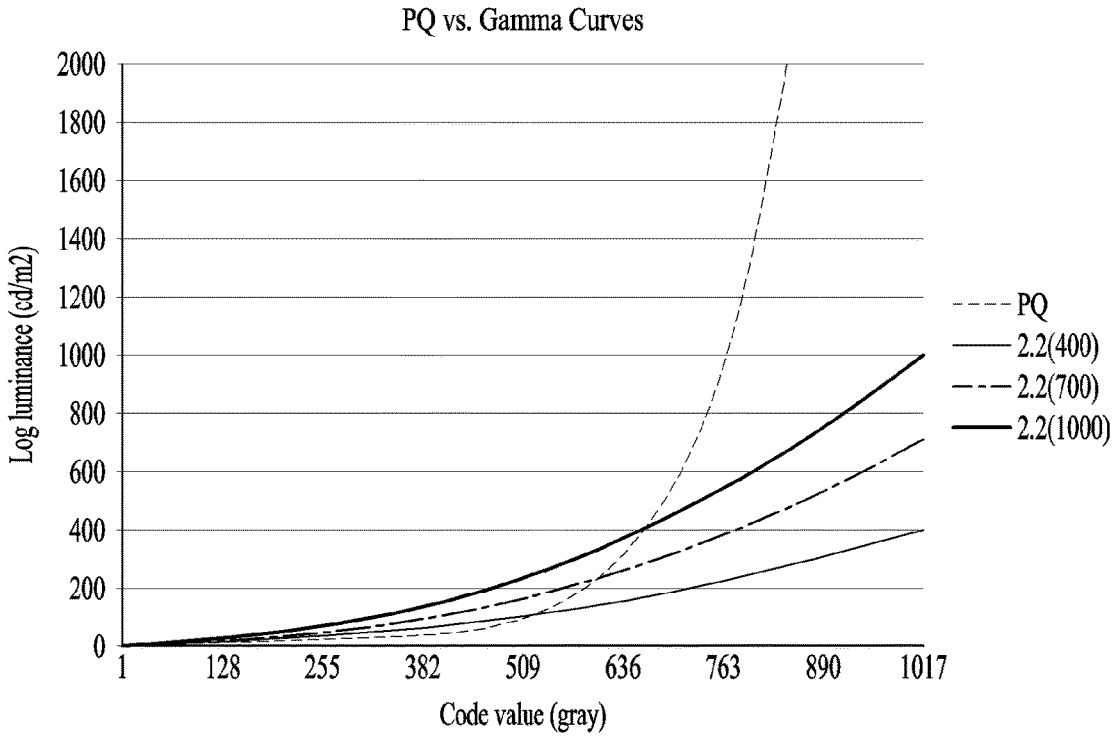
FIG. 3 is a diagram illustrating an example in which gray loss occurs when a gray scale of an HDR image is mapped according to a 2.2 gamma curve for understanding of the present invention.

FIG. 3 is a diagram illustrating an example in which gray loss occurs in the case of data mapping of a gray scale of an HDR image encoded according to the aforementioned PQ according to a 2.2 gamma curve.

As seen from FIG. 3, as maximum luminance 400, 800, 1000, 1500, 2000, and 4000 of the SDR display device is increased, loss in a low gray scale is increased. Fragmentarily, a gray scale of 16 encoded according to PQ may be mapped to a gray scale of 6 in a 2.2 gamma display device of a maximum of 400 nits but may be mapped to a gray scale of 2 in a 2.2 gamma display device of a maximum of 4000 nit, and thus it may be seen that high gray loss occurs in a low gray scale.

To overcome these problems, the present invention proposes an image processing method and an image processing circuit for minimizing gray loss due to mapping of an HDR image according to an SDR gamma curve and high gray saturation that can occur when a dynamic range of an HDR image is wider than a dynamic range of an SDR display device.

Figure 4:
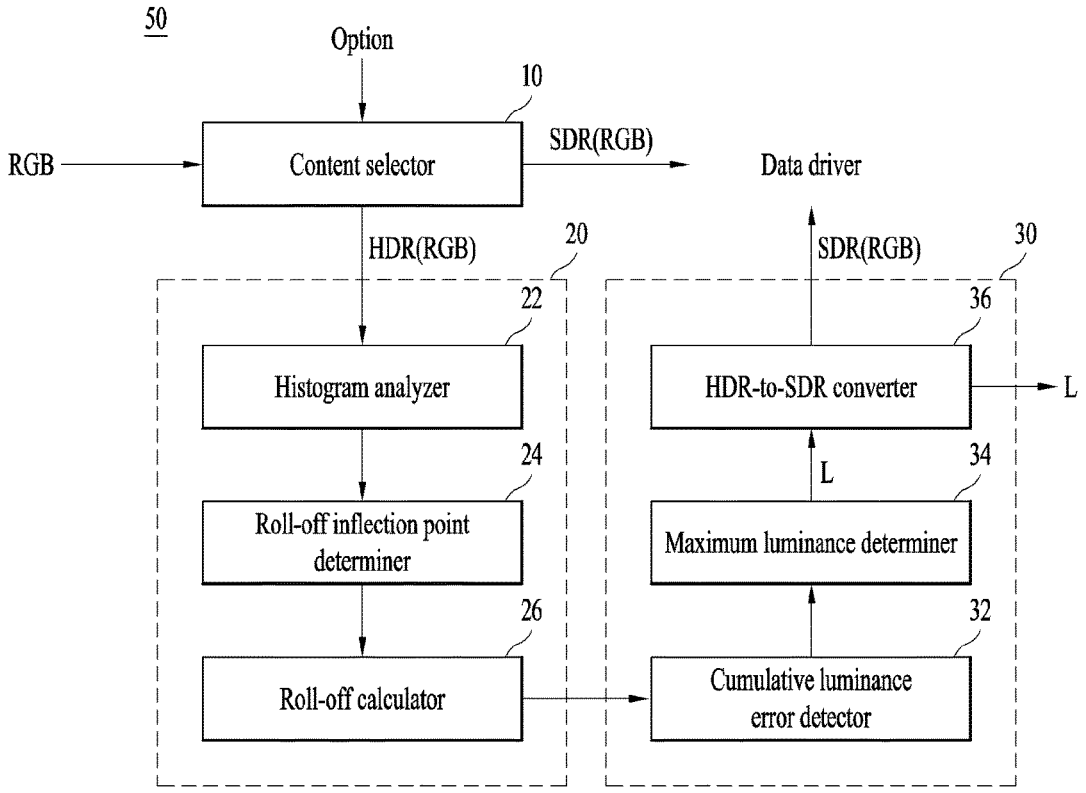
FIG. 4 is a schematic block diagram illustrating components of an image processing circuit according to an embodiment of the present invention.

FIG. 4 is a schematic block diagram illustrating components of an image processing circuit 50 according to an embodiment of the present invention.

The image processing circuit 50 illustrated in FIG. 4 may include a content selector 10, a roll-off processor 20, and an image mapper 30. The roll-off processor 20 may include a histogram analyzer 22, a roll-off inflection point determiner 24, and a roll-off calculator 26. The image mapper 30 may include a cumulative luminance error detector 32, a maximum luminance determiner 34, and an HDR-to-SDR converter 36.

The content selector 10 may receive an input image RGB and option information from an external source and determine whether the input image RGB is an HDR image or an SDR image according to the option information. The option information may include image information indicating whether the input image RGB is an HDR image or an SDR image. The content selector 10 outputs the input image RGB to the roll-off processor 20 when the input image RGB is an HDR image and outputs the input image RGB to a data driver when the input image RGB is an SDR image.

The roll-off processor 20 may use a roll-off processing scheme for adjusting overall luminance of a high gray region as dark in order to minimize high gray saturation via mapping prior to mapping of the HDR image provided from the content selector 10 to the SDR image. In particular, the roll-off processor 20 may adaptively perform roll-off processing according to image characteristics obtained by analyzing the input HDR image. The roll-off processor 20 may determine an inflection point (roll-off start point) indicating a gray position from which roll-off is adaptively started according to the image characteristics so as to minimize image quality degradation due to high gray saturation and an inflection point. In other words, the roll-off processor 20 may analyze an HDR image-based histogram to adaptively determine a roll-off inflection point (roll-off start point) according to a high gray frequency of high n % or more and perform and output roll-off processing on a high gray of the determined inflection point or more.

To this end, the roll-off processor 20 may include the histogram analyzer 22 that analyzes the DR image-based histogram and outputs high gray frequency of high n % or more, the roll-off inflection point determiner 24 that adaptively determines a roll-off inflection point according to the high gray frequency determined from the histogram analyzer 22, and the roll-off calculator 26 that performs calculation for roll-off processing on a high gray scale of the determined inflection point or more.

Figure 5:
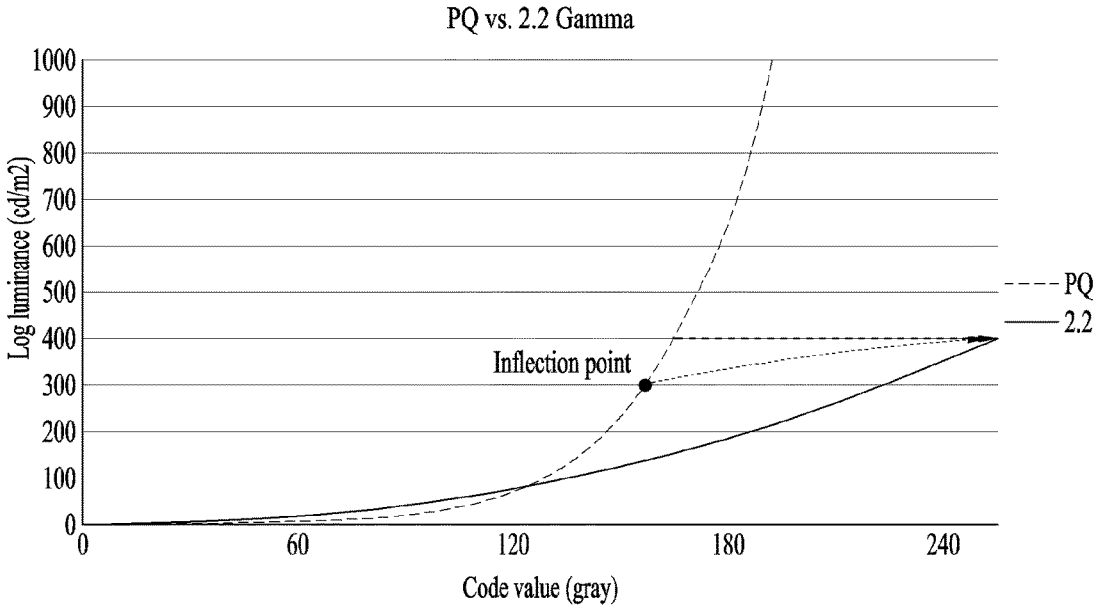
FIG. 5 is a graph for explanation of comparison between clamping processing and roll-off processing for minimizing high gray saturation by a roll-off processor illustrated in FIG. 4.

FIG. 5 is a graph for explanation of a roll-off method of the roll-off processor 20 illustrated in FIG. 4.

In FIG. 5, a dotted horizontal line with an arrow indicates a simple clipping method when a dynamic range of an input image is wider than a dynamic range of a display device. For example, the method may be a method for changing all high scales of 170 or more to 170 when luminance corresponding to a gray scale of 170 is 400 nits in the HDR image.

On the other hand, roll-off is a method for determining an arbitrary gray scale as an inflection point and inflecting the inflection point, as indicated by a dotted line originating from the inflection point illustrated in FIG. 5. In this regard, although high scale saturation compared with clipping can be reduced, image quality degradation can be recognized based on the inflection point, and thus the inflection point may be adaptively determined via analysis of an input image. In other words, the roll-off processor 20 may adaptively determine the inflection point according to image characteristics through histogram analysis of the HDR image so as to minimize image quality degradation due to high gray saturation and an inflection point.

Figure 6A:
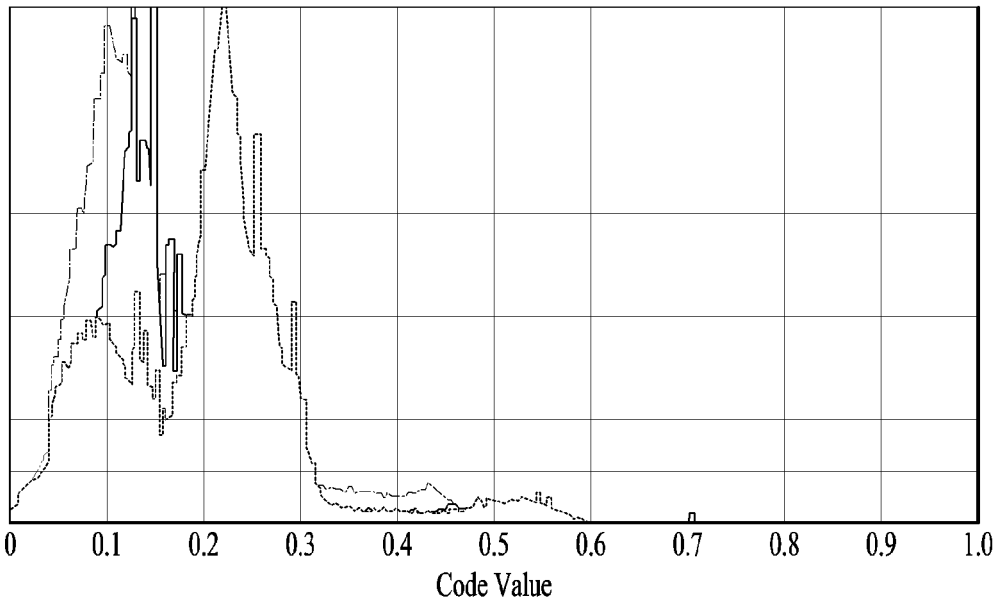
FIGS. 6A and 6B illustrate an example of histogram analysis of an HDR image for explanation of a method for adaptively determining a roll-off start point according image characteristics of the roll-off processor illustrated in FIG. 4.
Figure 6B:
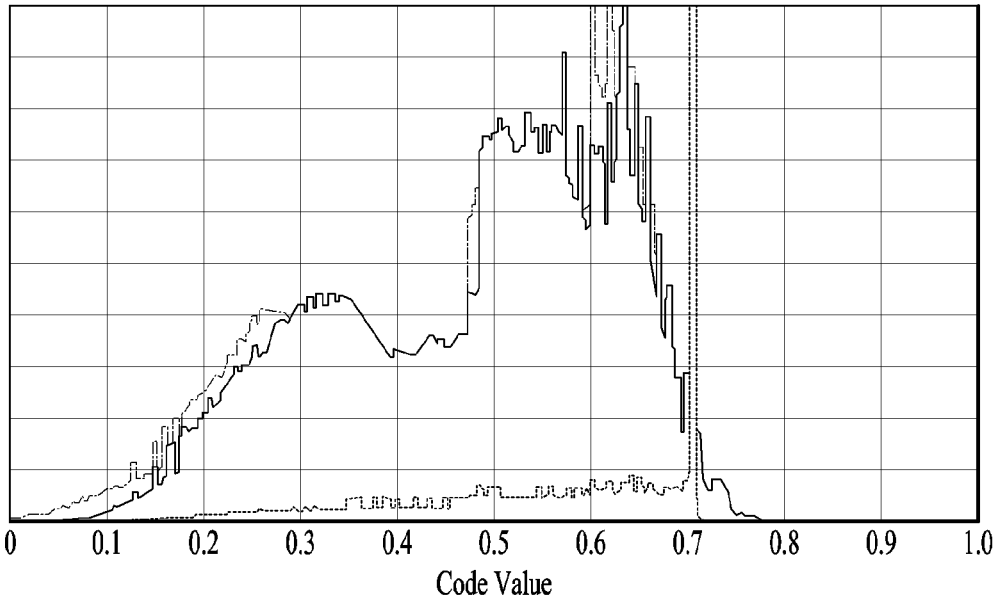

FIGS. 6A and 6B are diagrams for explaining of a method for adaptively determining a roll-off start point according image characteristics of the roll-off processor 20 illustrated in FIG. 4.

FIGS. 6A and 6B illustrate an example of histogram analysis of an HDR image, in which an X axis indicates normalized luminance and a Y axis indicates a frequency.

A transfer function (ST. 2084) of encoding an HDR image, that is, PQ EOTF may be defined according to Equation 1 below and luminance with respect to an input gray scale may be acquired using Equation 1 below.

$$L = \left( \frac{\max[(N^{1/m_2} - c_1), 0]}{c_2 - c_3 N^{1/m_1}} \right)^{1/m_1} \quad \text{[Equation 1]}$$

In Equation 1 above, L is luminance, N is an input gray scale, and $m_1$ to $m_2$ and $c_1$ to $c_3$ are each a constant. For example, $m_1$=2610/4096×(¼)=0.1593017578125, $m_2$=2523/4096×128=78.84375, $c_1$=3424/4096=0.8359375=$c_3$−$c_2$+1, $c_2$=2413/4096×32=18.8515625, and $c_3$=2392/4096×32=18.6875.

In the case of a dark image with a few high-gray regions as illustrated in FIG. 6A, it does not matter that a roll-off inflection point is positioned at a higher gray scale, but in the case of a light image with many high-gray region as illustrated in FIG. 6B, it may be preferable that a roll-off inflection point is positioned in a low gray scale if possible and is determined in consideration of image brightness.

In detail, the roll-off inflection point determiner 24 may determine a roll-off inflection point(Roll-off$_{pos}$) according to Equation 2 below in consideration of frequency of high gray regions of high n % from the histogram analyzer 22.

$$\text{If NumberOfGray}(n) > \text{Threshold Then Roll-off}_{pos} = (1-a) \times \text{Roll-off}_{initial}$$

$$\text{Else Roll-off}_{pos} = \text{Roll-off}_{initial} \quad \text{[Equation 2]}$$

When frequency of high-scale regions of high n % "NumberOfGray(n)" is higher than a threshold, a roll-off inflection point "Roll-off$_{pos}$" may be determined as "(1−a)× Rolloff$_{initial}$" and in addition, "roll-off inflection point(Roll-off$_{pos}$)" may be determined as an initially set roll-off initial inflection point "Roll-off$_{initial}$". Here, "a" is an experimental constant, and "a" is increased as luminance is increased and is reduced as luminance is reduced. "a" may be an empirical number via an experiment and may be set to be linearly proportional to luminance with fixed minimum and maximum values. The roll-off initial inflection point "Roll-Off$_{initial}$" may be pre-set according to the maximum luminance of a display device.

The roll-off calculator 26 may perform a multiplying operation on the roll-off inflection point "Roll-off$_{pos}$" determined according to the aforementioned image analysis by the roll-off inflection point determiner 24 and the input gray scale "Gray$_{in}$" to output a roll-off processed output gray scale "Gray$_{out}$" according to Equation 3 below.

$$\text{Gray}_{out} = (\text{Roll-off}_{pos}) \times (\text{Gray}_{in}) \quad \text{[Equation 3]}$$

For example, a maximum value GrayMax (0≤GrayMax≤255 when gray data has 8 bits) for each pixel may be detected among R, G, B gray data items in an image with a pixel size of 100×100. When a histogram is formed with a maximum value GrayMax for each pixel, an X axis is a gray scale in the range of 0 to 255 and a Y axis is a frequency. For example, a roll-off inflection point (Roll-off$_{pos}$) may be determined in consideration of a frequency (100×100×0.1) of a high gray region of high 10%.

A gray scale (X-m) that satisfies a condition of Initial X=255, (Histogram[X]+Histogram[X−1]+ . . . +Histogram [X-m])>(100×100×0.1) corresponds to a high gray region of high 10% of a corresponding image. When the image is overall dark, (X-m) may be close to 0, and when the image is light, (X-m) may be close to 255.

For example, when a threshold for determination of a roll-off inflection point is assumed as a gray scale of 192 and (X-m) is smaller than 192, a=0 and roll-off inflection point (Roll-off$_{pos}$) may not be determined to be adjusted and may be determined as a roll-off initial inflection point (Roll-off$_{initial}$).

On the other hand, when (X-m) is smaller than 192, a>0 and the roll-off inflection point (Roll-off$_{pos}$) may be changed to be close to 0 compared with the roll-off initial inflection point (Roll-off$_{initial}$).

In FIG. 4, the image mapper 30 may select a gamma curve for minimizing image quality degradation and map an HDR image to an SDR image using the selected gamma curve in order to minimize gray loss due to mapping. In other words, the image mapper 30 may perform image mapping on a gamma curve with minimum cumulative luminance error by receiving the HDR image that is roll-off processed by the roll-off processor 20 and calculating cumulative luminance error from a plurality of gamma curves with different luminance.

To this end, the image mapper 30 may include the cumulative luminance error detector 32 for detecting cumulative luminance error by mapping an HDR image input from the roll-off processor 20 according to a plurality of gamma curves with different luminance to calculate and accumulate luminance errors for respective frames, the maximum luminance determiner 34 for selecting a gamma curve with minimum error among cumulative luminance errors from the cumulative luminance error detector 32 and outputting maximum luminance (L) of the selected gamma curve, and the HDR-to-SDR converter 36 for converting an HDR image to an SDR image using a HDR-to-SDR look-up table (LUT) according to the determined maximum luminance (L) and outputting the converted SDR image to a data driver. Here, the cumulative luminance error detector 32 and the HDR-to-SDR converter 36 may be embodied in the form of an LUT.

A method for minimizing image quality degradation via mapping by the image mapper 30 will be described below.

As described above with reference to FIG. 2, with regard to a gamma curve, as maximum luminance is increased, low gray mapping may become more difficult and high gray mapping may become easier. This characteristic may be obtained and image quality degradation may be minimized as all pixels in an image encoded according to PQ during HDR to-SDR mapping display a wide range of luminance that the pixels were originally designed to express, and thus the image mapper 30 may select and map a gamma curve with minimum image quality degradation.

Figure 7:
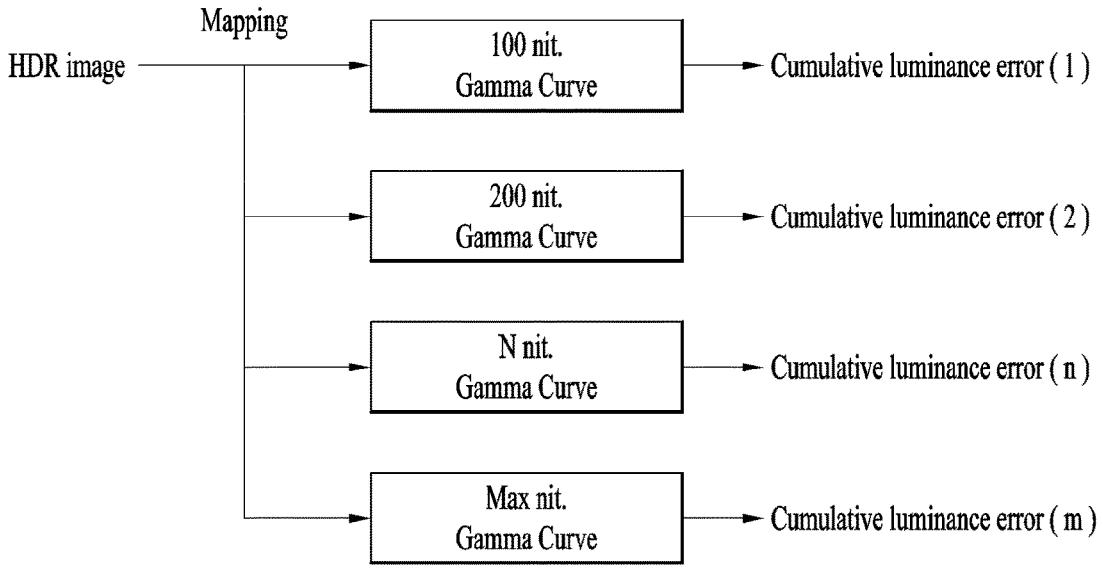
FIG. 7 is a block diagram illustrating internal components of a cumulative luminance error calculator illustrated in FIG. 4.

In other words, the image mapper 30 may calculate cumulative luminance error with 100 Max nits gamma curves illustrated in FIG. 7, select a gamma curve with minimum cumulative luminance error, and perform image mapping on the selected gamma curve.

When the cumulative luminance error is calculated according to an equation, circuit load may become more serious, and thus the cumulative luminance error detector 32 may be embodied in the form of an LUT according to Equation 4 below.

$i$=input gray scale, $n$ is a bit number, and $r$ is gamma exp (e.g., 2.2), [Equation 4]

Equation 1 above is referred to for PQ(i), Gamma(i)=$(i/(2^n-1))^r$,

Minimum Luminance Difference LUT($i$)=(PQ($i$)−Gamma($i$))/PQ($i$)

The maximum luminance determiner 34 may select a gamma curve with minimum cumulative luminance error among cumulative luminance errors output from the cumulative luminance error detector 32 and output maximum luminance (L) of the selected gamma curve to the HDR-to-SDR converter 36. The maximum luminance determiner 34 may level the maximum luminance (L) output from the maximum luminance determiner 34 during adjacent frames with a weight applied thereto using a time filter in order to prevent flicker due to sudden change or noise. The time filter may be an infinite impulse response (IIR) filter.

When the maximum luminance determiner 34 determines the maximum luminance (L) according to a gamma curve with minimum cumulative luminance error, the HDR-to-SDR converter 36 may convert the HDR image to the SDR image using the HDR-to-SDR LUT according to the determined maximum luminance (L). The HDR-to-SDR LUT may be pre-embodied according to Equation 5 below. PQ(i) may be conformable to the aforementioned Equation 1 above and may have a value in the range of 0 to 1. The HDR-to-SDR LUT may be defined according to Equation 5 below with respect to a gray scale of 0 to n (n is determined according to a maximum bit number of a display device. 8-bit is 255 and r=gamma of display device).

HDR-to-SDR LUT($i$)=Power(PQ($i$)*10,000/$L$,1/$r$)×$n$ [Equation 5]

The HDR-to-SDR converter 36 may include a plurality of LUTs according to maximum luminance (L) of a gamma curve, select an LUT corresponding to the maximum luminance (L) determined by the maximum luminance determiner 34, and convert the HDR image to the SDR image through the selected LUT. In this case, the HDR-to-SDR converter 36 may supply the determined maximum luminance (L), that is, the maximum luminance (L) of a gamma curve with a minimum cumulative luminance error to a dimming controller (not shown), and thus the dimming controller may use the aforementioned maximum luminance (L) to determine a dimming gain for controlling backlight luminance of a liquid crystal display device.

Table 1 below shows an example of a result obtained by calculating minimum cumulative luminance error of seven images by the cumulative luminance error detector 32 illustrated in FIG. 4.

In Table 1 below, first column luminance corresponding to a bold number corresponds to maximum luminance L of a gamma curve with minimum cumulative luminance error.

As seen from Table 1 below, images #1, #2, and #4 has minimum cumulative luminance error in a 100 nit gamma curve, an image #3 has minimum cumulative luminance error in a 200 nit gamma curve, images #5 and #7 have minimum cumulative luminance error in a 300 nit gamma curve, and an image #6 has minimum cumulative luminance error in a 500 nit gamma curve. Accordingly, maximum luminance L of a gamma curve with minimum cumulative luminance error may be determined according to image characteristics.

TABLE 1

| Luminance (cd/m$^2$) | #1 | #2 | #3 | #4 | #5 | #6 | #7 |
|---|---|---|---|---|---|---|---|
| 100 | **5.82** | **4.12** | 3.51 | **7.88** | 5.66 | 13.2 | 4.13 |
| 200 | 6.34 | 4.53 | **2.98** | 8.59 | 4.32 | 5.96 | 2.68 |
| 300 | 8.38 | 5.65 | 3.19 | 11.5 | **4.11** | 3.08 | **2.61** |
| 400 | 9.76 | 7.26 | 3.79 | 13.55 | 4.63 | 2.11 | 2.9 |
| 300 | 10.17 | 8.14 | 3.87 | 13.81 | 4.66 | **1.73** | 2.9 |
| 600 | 10.73 | 9.07 | 4.37 | 14.04 | 5.18 | 1.91 | 3.27 |
| 700 | 11.93 | 9 | 4.14 | 16.32 | 4.89 | 1.78 | 3.05 |
| 800 | 11.67 | 8.81 | 4.22 | 15.61 | 5.01 | 1.9 | 3.24 |
| 900 | 11.34 | 9.07 | 4.55 | 14.97 | 5.36 | 2.16 | 3.62 |
| 1000 | 12.75 | 9.79 | 4.67 | 16.94 | 5.58 | 2.13 | 3.64 |

Figure 8:
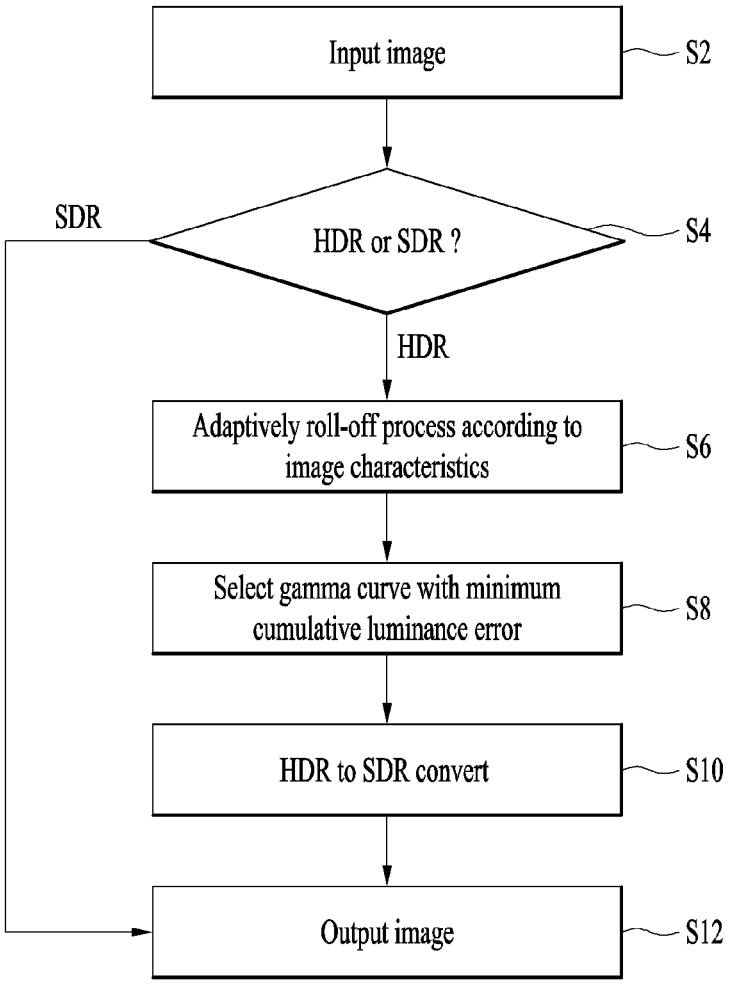
FIG. 8 is a flowchart that stepwise illustrates an image processing method according to an embodiment of the present invention.

FIG. 8 is a flowchart that stepwise illustrates an image processing method according to an embodiment of the present invention, and the method may be performed by the image processing circuit 50 illustrated in FIG. 4 and thus will be described in conjunction with FIG. 4.

When an image RGB is input to the content selector 10 illustrated in FIG. 4 in a step 2 (S2), whether the input image RGB is an HDR image or an SDR image is determined using option image in a step 4 (S4).

If the input image RGB is determined to be an HDR image in the step 4 (S4), the roll-off processor 20 may adaptively perform roll-off processing according to image characteristic obtained by analyzing the input HDR image in order to minimize high gray saturation via data mapping prior to mapping of the HDR image in a step 6 (S6). The roll-off processor 20 may analyze an HDR image-based histogram to adaptively determine a roll-off inflection point (roll-off start point) according to high gray frequency of high n % or more and may roll-off process and output a high gray scale of the determined inflection point or more.

In a step 8 (S8), the image mapper 30 may select a gamma curve with minimum image quality degradation and map the HDR image to the SDR image using the gamma curve selected in a step 10 (S10) in order to minimize gray loss due to image mapping. The image mapper 30 may detect cumulative luminance error of an HDR image supplied from the roll-off processor 20 for each gamma curve using cumulative luminance error LUTs that are respectively set according to a plurality of gamma curves with different maximum luminance, select a gamma curve with minimum cumulative luminance error, and convert the HDR image to the SDR image using the selected gamma curve.

In a step 12 (S12), the SDR image converted in the step 10 (S10) or the SDR image determined in the step 4 (S4) is output to a data driver. When an HDR image is displayed on an SDR display device using the image processing method according to an embodiment of the present invention, luminance may be enhanced and image quality may be improved compared with the case in which simple data mapping is performed on an HDR original image.

Accordingly, according to the present invention, an SDR display device that is not conformable to the HDR standard (ST. 2084) may also realize an HDR image encoded according to ST. 2084 with minimized image quality degradation so as to selectively display the SDR image and the HDR image without gamma change of a data driver, thereby minimizing cost increase of the data driver, a timing controller, and so on.

The aforementioned image processing circuit and method according to the present invention may also be applied to a liquid crystal display device, an organic light emitting diode display device, and other type of display device.

Figure 9:
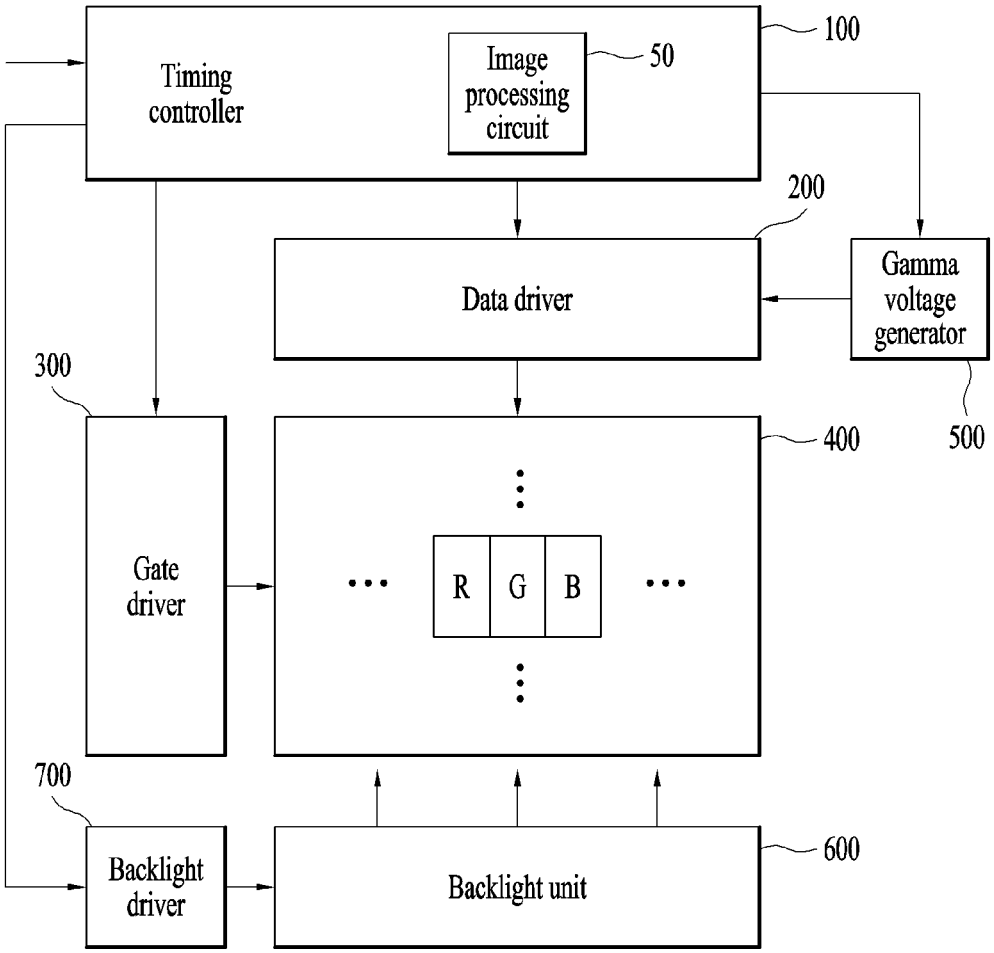
FIG. 9 is a block diagram illustrating an example of a liquid crystal display device to which an image processing circuit according to an embodiment of the present invention is applied.

FIG. 9 is a block diagram illustrating an example of a liquid crystal display device to which an image processing circuit according to an embodiment of the present invention is applied.

The liquid crystal display device illustrated in FIG. 9 may include a timing controller 100, a data driver 200 and a gate driver 300 that are panel drivers, a display panel 400, a gamma voltage generator 500, a backlight unit 600, a backlight driver 700, and a power unit (not shown).

The display panel 400 may display an image through a pixel array in which pixels are arranged in a matrix form. Each pixel of the pixel array may include red (R), green (G), and blue (B) sub-pixels. On the other hand, each pixel may include R/W/B/G sub-pixels formed by adding a white (W) sub-pixel with higher luminance efficiency than the RGB sub-pixel. The display panel 400 may be an LCD panel, an OLED panel, or other type of display.

The data driver 200 may receive a data control signal and image data from the timing controller 100. The data driver 200 may be driven according to the data control signal, may subdivide a reference gamma voltage set supplied from the gamma voltage generator 500 to gray voltages corresponding to respective gray scale of the data, and then may convert digital image data into an analog image data signal using the subdivided gray voltages.

The data driver 200 may include a plurality of data drive ICs for separately driving data lines of the display panel 400, and each data drive IC may be mounted on a circuit film such as a tape carrier package (TCP), a chip on film (COF), and a flexible print circuit (FPC) and attached to the display panel 400 using a tape automatic bonding (TAB) method or may be mounted on the display panel 400 using a chip on glass (COG) method.

The gate driver 300 may separately drive a plurality of gate lines of the display panel 400 using a gate control signal supplied from the timing controller 100. The gate driver 300 may supply a scan pulse of a gate on voltage in a corresponding scan period to each gate line in response to a gate control signal and supply a gate open voltage in the remaining period. The gate driver 300 may receive the gate control signal from the timing controller 100 or receive the gate control signal from the timing controller 100 through the data driver 200. The gate driver 300 may include at least one gate IC and may be mounted on a circuit film such as a TCP, a COF, and an FPC and attached to the display panel 400 using a TAB method or may be mounted on the display panel 400 using a COG method. On the other hand, the gate driver 300 may be formed together with a thin film transistor array constituting a pixel array of the display panel 400 so as to be embodied as a type of a gate in panel (GIP) installed in a non-display area of the display panel 400.

The timing controller 100 may receive image data, a timing signal, and so on from an external host system. The timing controller 100 may perform image processing such as required image compensation on the input image data and output the image data to the data driver 200. The timing controller 100 may generate a data control signal and a gate control signal for respectively controlling driving timings of the data driver 200 and the gate driver 300 using the input timing signals and output the data control signal and the gate control signal to the data driver 200 and the gate driver 300, respectively. The timing signal that is supplied to the timing controller 100 from the host system may include a dot clock, a data enable signal, a vertical synchronization signal, a horizontal synchronization signal, but the vertical synchronization signal and the horizontal synchronization signal may be omitted. When the vertical synchronization signal and the horizontal synchronization signal are omitted, the timing controller 100 may count a data enable signal according to the dot clock and generate and use the vertical synchronization signal and the horizontal synchronization signal. The data control signals supplied to the timing controller 100 may include a source start pulse, a source sampling clock, a polarity control signal, a source output enable signal, and so on. Gate control signals supplied to the gate driver 300 from the timing controller 100 may include a gate start pulse, a gate shift clock, a gate output enable signal, and so on.

The image processing circuit 50 described with reference to FIG. 4 may be installed in the timing controller 100 as illustrated in FIG. 9, positioned between the timing controller 100 and the data driver 200, or positioned at an input terminal of the timing controller 100. The image processing circuit 50 may determine whether the input image data is an HDR image or an SDR image, bypass the SDR image, and minimize high gray saturation and image quality degradation of the HDR image to map and output the HDR image to the SDR image. The image processing circuit 50 may determine a roll-off inflection point according to HDR image characteristic and perform roll-off processing a high gray scale equal to or more than an inflection point, thereby minimizing high gray saturation. In addition, the image processing circuit 50 may determine a gamma curve with cumulative minimum luminance error of the HDR image and map the HDR image to the SDR image according to the determined gamma curve LUT so as to minimize image quality degradation.

The image processing circuit 50 may supply maximum luminance (L) determined from the gamma curve with cumulative minimum luminance error to a dimming controller installed in the timing controller 100. Accordingly, the dimming controller may determining a dimming value for controlling the luminance of the backlight unit 600 using the maximum luminance (L) determined from the image processing circuit 50 and supply the dimming value to the backlight driver 700.

The backlight unit 600 may use a fluorescent lamp such as CCFL and EEFL or a light direct type or edge type backlight that includes an LED as a light source. The light direct type backlight may include light sources that are arranged on an entire display area so as to face a rear surface of the display panel 400, a light guide plate disposed on the light sources, and a plurality of optical sheets, and irradiate light emitted from the light sources to a liquid crystal panel 40 through the plurality of optical sheets. The edge type backlight may include a light guide plate facing the rear surface of the display panel 400, light sources arranged to face at least one edge of the light guide plate, and a plurality of optical sheets disposed on the light guide plate, and convert light emitted from the light sources into surface light through the light guide plate and irradiate the light to the display panel 400 through the plurality of optical sheets.

The backlight driver 700 may adjust luminance of the backlight unit 600 according to the dimming value from the timing controller 100. The backlight driver 700 may generate a pulse width modulator (PWM) signal with a duty ratio corresponding to the dimming value and drive the backlight unit 600 so as to control the luminance of the backlight unit 600.

Likewise, an image processing method and circuit, and a display device using the same according to the present invention may data-convert an HDR image encoded according to the HDR standard to an image encoded according to the SDR standard in an SDR display device so as to realize both an SDR image and an HDR image with image quality degradation of minimum error without gamma transformation of a drive IC.

In other words, an image processing method and circuit, and a display device using the same according to the present invention may adaptively determine a roll-off inflection point via analysis of an HDR image so as to minimize high gray saturation, may determine a gamma curve with cumulative minimum luminance error of the HDR image, and may convert the HDR image into the SDR image, thereby minimizing gray loss due to HDR-to-SDR mapping. Accordingly, image quality degradation of the HDR image may be minimized and the HDR image may be output to the SDR display device.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A method for processing an image, the method comprising:

selecting, by an image mapper of an image processing circuit, a gamma curve with a first image having a high dynamic range (HDR) and cumulative minimum luminance error among a plurality of gamma curves corresponding to a display device having a standard dynamic range (SDR) in order to display the first image in the display device by:

mapping the first image to each of the gamma curves with different maximum luminance to calculate luminance error for each frame, accumulating the calculated luminance error, and detecting cumulative luminance error for each of the gamma curves;

selecting the gamma curve with the cumulative minimum luminance error among the cumulative luminance error of each of the gamma curves; and determining a maximum luminance of the selected gamma curve; and converting, by the image mapper, the first image into a second image having the SDR according to the selected gamma curve by:

selecting a look-up table (LUT) corresponding to the determined maximum luminance among preset HDR-to-SDR converting LUTs corresponding to each of the gamma curves; and mapping the first image to the second image using the selected LUT.

2. The method according to claim 1, further comprising, prior to selection of any one of the gamma curves:

determining a roll-off inflection point according to image characteristics based on a result obtained via analysis of the first image; and roll-off processing a high gray scale equal to or more than the determined roll-off inflection point in the first image.

3. The method according to claim 2, wherein the determining of the roll-off inflection point comprises analyzing a histogram of the first image to calculate a high gray frequency of high n % (n is a natural number less than 100) or more and adaptively determining the roll-off inflection point according to the calculated high gray frequency.

4. The method according to claim 3, further comprising, prior to the analyzing of the first image, determining whether an input image is an HDR image or an SDR image according to an option image; and bypassing the input image when the input image is the SDR image and supplying the input image as the first image when the input image is the HDR image.

5. An image processing circuit comprising:

a roll-off processor for determining a roll-off inflection point according to image characteristics based on a result obtained via analysis of a first image having a high dynamic range (HDR) and roll-off processing a high gray scale equal to or more than the determined roll-off inflection point in the first image in order to display the first image having a HDR in a display device having a standard dynamic range (SDR); and an image mapper for selecting a gamma curve with the first image and cumulative minimum luminance error among a plurality of gamma curves corresponding to the display device, and converting the first image into a second image with the SDR according to the selected gamma curve.

6. The image processing circuit according to claim 5, wherein the roll-off processor comprises:

a histogram analyzer for analyzing a histogram of the first image to calculate and output a high gray frequency of high n % (n is a natural number less than 100) or more; and a roll-off inflection point determiner for adaptively determining the roll-off inflection point according to the calculated high gray frequency.

7. The image processing circuit according to claim 5, wherein the image mapper comprises:

a cumulative luminance error detector for mapping the first image to each of the gamma curves with different maximum luminance to calculate luminance error for each frame, accumulating the calculated luminance error, and detecting cumulative luminance error for each of the gamma curves;

a maximum luminance determiner for selecting the gamma curve with the cumulative minimum error among the cumulative luminance error of each of the gamma curves and determining and outputting maximum luminance of the selected gamma curve; and an HDR-to-SDR converter for selecting a look-up table (LUT) corresponding to the determined maximum luminance among preset HDR-to-SDR converting LUTs corresponding to the respective gamma curves and mapping the first image to the second image using the selected LUT.

8. The image processing circuit according to claim 7, further comprising:

a content selector positioned in front of the roll-off processor, for determining whether an input image is an HDR image or an SDR image according to an option image, bypassing the input image when the input image is the SDR image, and supplying the input image as the first image to the roll-off processor when the input image is the HDR image.

9. A display device comprising:

a display panel;

an image processing circuit comprising:

a roll-off processor for determining a roll-off inflection point according to image characteristics based on a result obtained via analysis of a first image having a high dynamic range (HDR) and roll-off processing a high gray scale equal to or more than the determined roll-off inflection point in the first image in order to display the first image having a HDR in a display device having a standard dynamic range (SDR); and an image mapper for selecting a gamma curve with the first image and cumulative minimum luminance error among a plurality of gamma curves corresponding to the display device, and converting the first image into a second image with the SDR according to the selected gamma curve;

a panel driver for displaying an image supplied from the image processing circuit in the display panel; and a timing controller for controlling driving timing of the panel driver, wherein the image processing circuit is installed in the timing controller, positioned between the timing controller and the panel driver, or positioned at a front end of the timing controller.

10. The display device according to claim 9, wherein the roll-off processor comprises:

a histogram analyzer for analyzing a histogram of the first image to calculate and output a high gray frequency of high n % (n is a natural number less than 100) or more; and a roll-off inflection point determiner for adaptively determining the roll-off inflection point according to the calculated high gray frequency.

11. The display device according to claim 9, wherein the image mapper comprises:

a cumulative luminance error detector for mapping the first image to each of the gamma curves with different maximum luminance to calculate luminance error for each frame, accumulating the calculated luminance error, and detecting cumulative luminance error for each of the gamma curves;

a maximum luminance determiner for selecting the gamma curve with the cumulative minimum error among the cumulative luminance error of each of the gamma curves and determining and outputting maximum luminance of the selected gamma curve; and an HDR-to-SDR converter for selecting a look-up table (LUT) corresponding to the determined maximum luminance among preset HDR-to-SDR converting LUTs corresponding to the respective gamma curves and mapping the first image to the second image using the selected LUT.

12. The display device according to claim 11, further comprising:

a content selector positioned in front of the roll-off processor, for determining whether an input image is an HDR image or an SDR image according to an option image, bypassing the input image when the input image is the SDR image, and supplying the input image as the first image to the roll-off processor when the input image is the HDR image.

13. The display device according to claim 9, further comprising;

a backlight unit for irradiating light to the display panel; and a backlight driver for adjusting luminance of the backlight unit in response to a dimming value output from the timing controller using the maximum luminance determined by the image processing circuit.

* * * * *